US008474619B1

(12) United States Patent
Chrisman

(10) Patent No.: US 8,474,619 B1
(45) Date of Patent: Jul. 2, 2013

(54) UNITARY GIFT CARD BOX

(76) Inventor: Craig R. Chrisman, Christianburg, VA (US)

( * ) Notice: Subject to any disclaimer, the term of this patent is extended or adjusted under 35 U.S.C. 154(b) by 171 days.

(21) Appl. No.: 12/927,846

(22) Filed: Nov. 29, 2010

(51) Int. Cl.
*B65D 85/48* (2006.01)
*B65D 25/00* (2006.01)

(52) U.S. Cl.
USPC ..... 206/449; 206/768; 206/757; 206/765; 40/124.08

(58) Field of Classification Search
USPC ..... 206/768, 757, 425, 312, 232, 308.1, 206/762, 449, 759, 764, 765, 766, 485; 229/160.2, 102.5, 120.21; 40/124.08, 124.16, 40/124.14
See application file for complete search history.

(56) References Cited

U.S. PATENT DOCUMENTS 1,157,942 A * 10/1915 Keller ..... 229/125.21
1,458,170 A * 6/1923 Dietsche, Jr. ..... 248/152
2,207,567 A 7/1940 Warner
2,511,211 A * 6/1950 Klein et al. ..... 206/45.28
2,932,439 A 4/1960 Sparling
4,765,535 A 8/1988 Michetti
5,065,935 A 11/1991 Mancel
5,364,015 A 11/1994 Hirschey
5,381,949 A 1/1995 Correll
5,588,233 A * 12/1996 Volkert et al. ..... 40/124.08
5,830,033 A * 11/1998 Piron ..... 446/150
5,887,782 A * 3/1999 Mueller ..... 229/183
6,223,979 B1 5/2001 Correll
6,386,370 B1 * 5/2002 Wigton et al. ..... 206/763
7,938,270 B2 * 5/2011 Davis ..... 206/768
2005/0258060 A1 * 11/2005 Katz ..... 206/425
2010/0012672 A1 * 1/2010 Piron ..... 220/811

* cited by examiner

*Primary Examiner* — Mickey Yu
*Assistant Examiner* — Chun Cheung
(74) *Attorney, Agent, or Firm* — New River Valley IP Law; Michele L. Mayberry

(57) ABSTRACT

A unitary gift box of clam-shell design constructed of cardboard and decorative wrapping paper is configured to releasably hold a gift card. The gift card is secured within a folded pop-up structure that moves the card to a prominently displayed position when the box is opened.

12 Claims, 3 Drawing Sheets

UNITARY GIFT CARD BOX

BACKGROUND OF THF INVENTION

1. Field of the Invention

This invention relates to small, relatively rigid cardboard boxes, and more particularly concerns an ornamental clam shell type box enclosure for a gift card.

2. Boxes fabricated of a single piece of cardboard having interconnected upper and lower portions adapted to interengage in clam shell manner are well known. Some of said boxes are intended to enclose an item of merchandise and are sealed upon said merchandise at the time of manufacture of the box. In those instances where the enclosed item is intended as a gift, ornamental gift wrap paper may be applied to the exterior of the box at the time of its manufacture.

U.S. Pat. No. 2,207,567 to Warner discloses a box intended for use as a mailing carton for merchandise. The carton is made from a single piece of cardboard having a sheet of wrapping paper adhered to that surface of the cardboard which will become the exterior surface of the box. The cardboard with attached wrapping paper is folded and glued in a manner to form a box of clamshell configuration. The merchandise is inserted into the box and the box is sealed by way of laterally extending flap portions of the wrapping paper which become glued to the bottom of the box. Therefore, the box cannot be opened without destruction of certain features of the box.

Gift cards are generally available as gift items. Such cards are fabricated of substantially rigid plastic in wallet-sized rectangular shape having a standardized length of 85 mm and width of 53 mm; namely a size and shape identical to that of credit cards and driver's licenses. The gift cards contain coded information, generally in the form of a magnetic strip, which indicates a dollar value for which the card can be used for purchases or exchanged for cash redemption. When presented as a gift, the card is aesthetically unappealing because it does not conform with the general perception of gifts as being packaged in neat boxes covered with decorative wrapping. Those who sell or otherwise provide gift cards accordingly seek an effective yet convenient and inexpensive way to package individualized gift cards with awareness of the old adage that "good things come in small packages".

It is consequently an object of this invention to provide a gift box of clam shell configuration having attached decorative outer wrapping, and which can be opened and closed without destruction of features of the box.

It is a further object of this invention to provide a box of the aforesaid nature having an interior configuration which easily and securely accommodates a gift card in a manner to be prominently displayed when the box is opened.

These objects and other objects and advantages of the invention will be apparent from the following description.

SUMMARY OF THF TNVFNTTON

The above and other beneficial objects and advantages are accomplished in accordance with the present invention by a box of rectangular shape fabricated of a single cardboard sheet bounded by interior and exterior faces and a contoured primary perimeter, and a layer of wrapping paper attached to said exterior face and extending beyond said primary perimeter to a contoured secondary perimeter, said sheet containing scored lines which permit folding to produce said box which is comprised of:

a) a lower portion integrally joined to an upper portion by way of folding upon two lines spaced apart so as to constitute a rear sidewall of said box, said folding interaction sequentially producing:
   1) a closed state defining a compartment bounded in part by said upper and lower portions, and
   2) an open state wherein said upper portion is positioned orthogonally to said lower portion, and
b) means for releasably securing a gift card within said compartment in a manner which moves said card into parallel relationship with said upper portion in the open state of said box.

BRIEF DESCRIPTION OF THF DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 2:
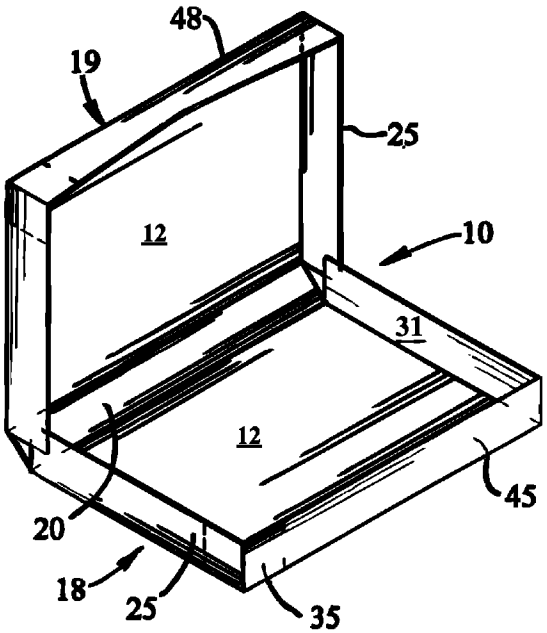
FIG. 2 is a front and side perspective view of an embodiment of a box of this invention produced from the blank of FIG. 1, said box shown in its open state and without securing means for a gift card.
Figure 1:
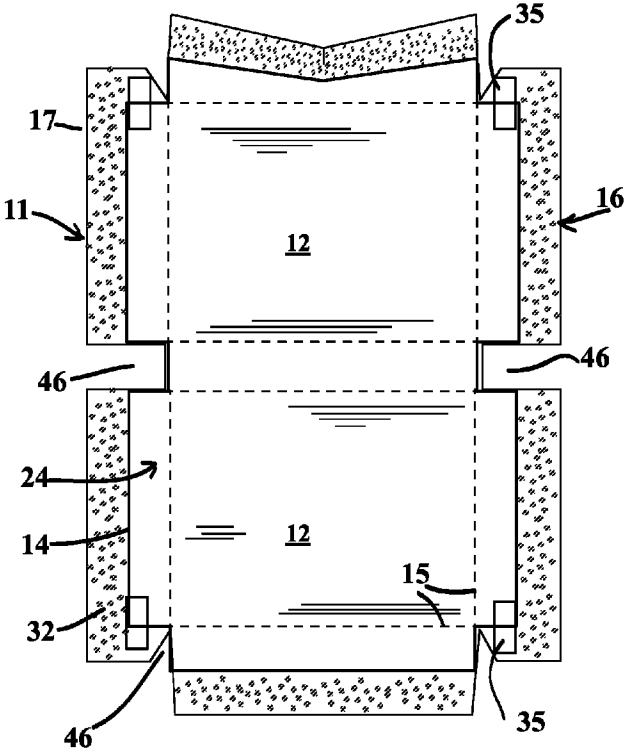
FIG. 1 is a plan view of a cardboard blank from which an embodiment of the box of this invention is fabricated.

Referring now to FIGS. 1-7, an embodiment of the gift box 10 of this invention is shown having been fabricated from blank 11. Said blank is comprised of a single sheet of cardboard 24 bounded by flat interior and exterior faces 12 and 13, respectively, and contoured primary perimeter 14. Scored lines 15 produce structural weakening of the cardboard sheet, thereby permitting controlled folding.

A layer of wrapping paper 16 is adhered to exterior face 13 of the cardboard sheet; and extends beyond said primary perimeter to a contoured secondary perimeter 17 having cutaway gaps 46.

By virtue of downward and inward folding of sheet 24 along said lines of scoring 15, long and short skirt portions 45 and 25, respectively, are formed. Said skirt portions terminate in distal edges 30 and have inside faces 31 which are adhered to border portions 32 of said wrapping paper that extend beyond said primary perimeter and have been folded over said distal edges and adhered onto said inside faces.

Box 10 is comprised of a lower, body portion 18 foldably interactive with an upper, cover portion 19 in a region of said sheet which becomes the rear sidewall 20 of the box. Said interaction produces a closed state of the box, having compartment 21 bounded in part by rectangular top and bottom surfaces 22 and 23, respectively, consisting of portions of interior face 12.

When said body and cover portions are folded to the closed state of the box, said skirt portions overlap to produce opposed lateral sidewalls 26 and front sidewall 27. In order to achieve said result, it is necessary that both rectilinear dimensions of top surface 22 exceed the corresponding dimensions of bottom surface 23 by 2-5 millimeters. In said closed state, compartment 21 is of rectangular shape, elongated in the direction between lateral sidewalls 26, and bounded in part by said front, rear and lateral sidewalls. Because of the specialized unitary construction of the blank 11, the box is easily constructed and folded to its closed state in a simple machine operation. In a preferred embodiment, the front skirt portion associated with top surface 22 is bilaterally tapered inwardly toward the center of the box to form a V-notch 48 which facilitates the lifting of cover portion 19.

Figure 6:
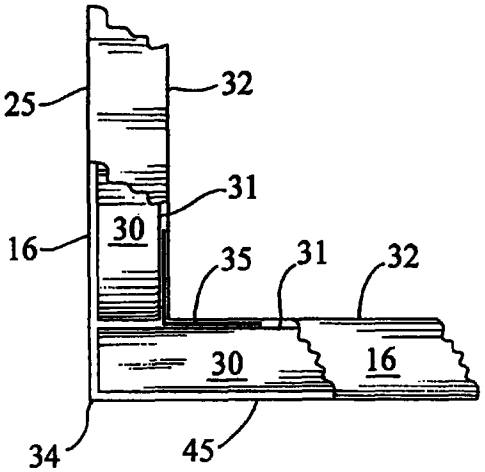
FIG. 6 is a greatly enlarged fragmentary view taken in the direction of the arrows upon line 6-6 of FIG. 3 with portions broken away to reveal interior details.

The four front corners 34, formed at the intersections of the skirt portions comprising said lateral and front sidewalls, are preferably stabilized, as best shown in FIG. 6, by adhered portions of said wrapping paper and stiff paper inserts 35 sandwiched between said wrapping paper and inside faces 31 of said skirt portions. By virtue of the effect of said inserts at the front corners of the box, the box is sufficiently durable to retain its shape and appearance in the course of repeated cycles of opening and closing.

Figure 3:
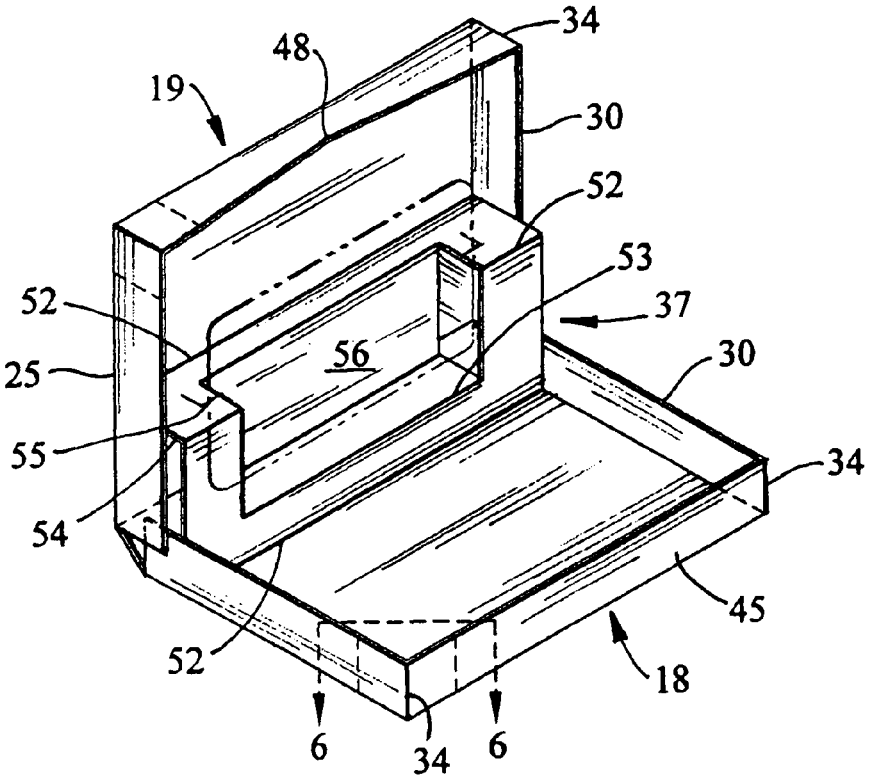
FIG. 3 is a front and side perspective view of the box of FIG. 2 shown containing securing means for a gift card.
Figure 4:
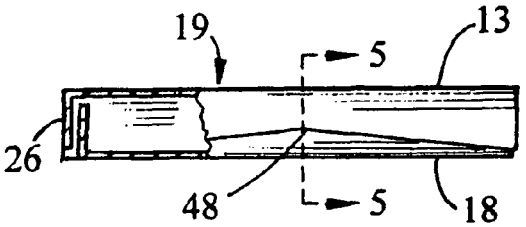
FIG. 4 is a front view of the box of FIG. 3 shown in its closed state, with portions broken away to reveal interior details.
Figure 7:
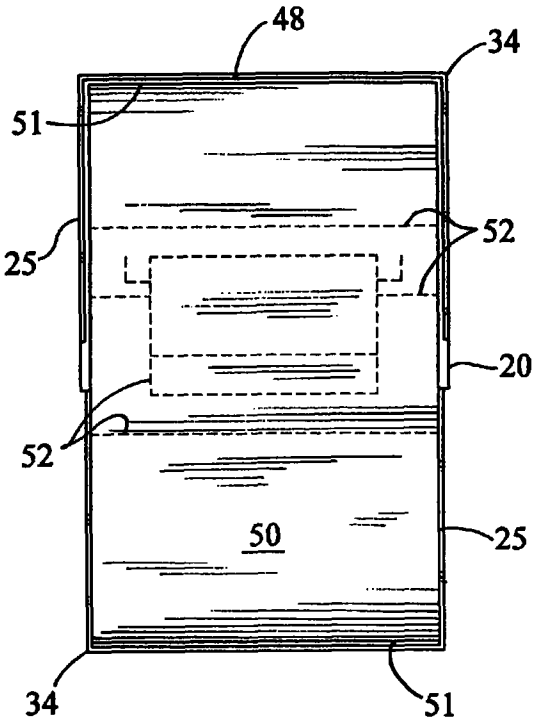
FIG. 7 is a plan view of said box in an intermediate stage of its fabrication.

A card holder 37, preferably fabricated from an integral panel 50 of stiff paperboard, is adhered at its longitudinal extremities 51 to interior face 12. Panel 50 is preferably installed onto interior face 12, as shown in FIG. 7, before the folding operation which produces the box. Panel 50 contains six prescored parallel lines 52 which are laterally directed, namely directed between short skirt portions 25. When cover portion 19 is folded onto body portion 18, sections of panel 50 move toward the interior of compartment 21. In the initial stage of folded deployment, as shown in FIG. 3 wherein the box is in its open state and cover portion 19 is perpendicular to body portion 18, a platform 53 is formed and projected forwardly from surface 12. Paired shoulder portions 54 are caused to embrace platform 53. Card-holding slots 55 formed in said shoulder portions releasibly secure a gift card 56 seated upon platform 53 in a prominently viewable position.

Figure 5:
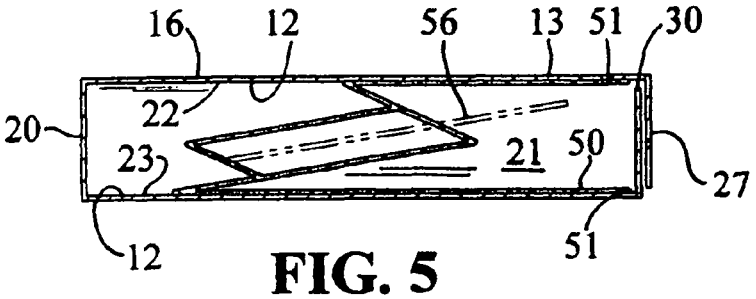
FIG. 5 is a sectional view taken in the direction of the arrows upon the line 5-5 of FIG. 4.

Downward folding of the cover portion to the closed state of the box, as shown in FIG. 5, causes card holder 37 to achieve a compacted state while maintaining card 56 in a position of readiness for pop-up display. The box is of minimal cost primarily in view of its substantially unitary construction, requiring no manual assembly costs. Because it is constructed totally of paper products, it is disposable in an environmentally acceptable manner.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A box of rectangular shape fabricated of a single cardboard sheet bounded by interior and exterior faces and a contoured primary perimeter, and a layer of wrapping paper attached to said exterior face and extending beyond said primary perimeter to a contoured secondary perimeter, said sheet containing scored lines which permit folding to produce said box which is comprised of:

a) a lower portion integrally joined to an upper portion by way of folding upon two lines spaced apart so as to constitute a rear sidewall of said box, said lower and upper portions each bounded by straight front and side extremities, said folding interaction sequentially producing:

1) a closed state defining a compartment bounded in part by said upper and lower portions, and 2) an open state wherein said upper portion is positioned orthogonally to said lower portion, and b) means for releasably securing a gift card within said compartment in a manner which moves said card into parallel relationship with said upper portion in the open state of said box, wherein said means is a panel insert comprising two parallel cuts each disposed perpendicular to and in communication with three inner folding lines, which together provide for a pop-up platform for the gift card when the box is open, and wherein two outer folding lines define an upper and lower base of the platform but the parallel cuts are not in communication with either of the two outer folding lines, wherein said pop-up platform projecting horizontally forward of said upper portion, wherein panel shoulders embrace said platform, and have card-holding slots which releasably secure said gift card in a prominently viewable position parallel to said upper portion.

2. The box of claim 1 wherein skirt portions are formed in said upper and lower portions by the folding of said sheet upon said scored lines, and the skirt portions of said upper and lower portions are dimensioned to overlap in said closed state to produce lateral and front walls as enclosing boundary components of a thereby defined rectangular compartment.

3. The box of claim 2 wherein each skirt portion terminates in a distal edge and has an inside face directed toward the interior of said compartment, said inside face securing a layer of said wrapping paper that had initially extended beyond said primary perimeter and had been folded over said distal edge and adhered onto said inside face.

4. The box of claim 3 further comprising two front corners in each of said lower and upper portions.

5. The box of claim 4 wherein said corners are reinforced by way of stiff paper inserts which are adhered between the inside faces of said skirt portions and the associated overlapping layer of wrapping paper.

6. The box of claim 2 which, in said closed state, is of rectangular shape, elongated in the direction between said opposed lateral sidewalls.

7. The box of claim 6 wherein the skirt portion associated with the front extremity of said upper portion is bilaterally tapered inwardly toward the center of the box to form a V-notch which facilitates the lifting of the upper portion of the box.

8. The box of claim 1 wherein said means for releasably securing a gift card is the panel insert fabricated of an integral panel of stiff paper board adhered to the interior face of said cardboard sheet.

9. The box of claim 8 wherein the two parallel cuts adapted to permit and direct folding and allow portions to raise away from the body of said panel.

10. The box of claim 9 wherein the nature of the two parallel cuts is such as to cause sections of said panel to move toward the interior of the compartment of said box in the closed state.

11. The box of claim 1 wherein the panel has a front face and the back face and, at the two outer folding lines, the panel is folded such that the front face folds toward itself and, at each of the two of the three inner folding lines, the panel is folded such that the back face folds toward itself.

12. The box of claim 1 wherein a cross-sectional view of the box when closed provides for an inner four-sided polygon disposed within the box, and wherein the inner polygon and box do not share any side.

* * * * *